US010076846B2

(12) United States Patent
Ranieri et al.

(10) Patent No.: US 10,076,846 B2
(45) Date of Patent: Sep. 18, 2018

(54) SLIDING BLADE UTILITY KNIFE

(71) Applicant: Stanley Black & Decker, Inc., New Britain, CT (US)

(72) Inventors: Eric Ranieri, Besanson (FR); Keith M. Lombardi, Avon, CT (US); Kenneth W. Strickland, South Glastonbury, CT (US); Cajan Lin, Taichung (TW); John Parente, Burlington, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 160 days.

(21) Appl. No.: 14/826,552

(22) Filed: Aug. 14, 2015

(65) Prior Publication Data

US 2016/0046026 A1 Feb. 18, 2016

Related U.S. Application Data

(60) Provisional application No. 62/037,990, filed on Aug. 15, 2014.

(51) Int. Cl.
*B26B 1/00* (2006.01)
*B26B 3/00* (2006.01)
(Continued)

(52) U.S. Cl.
CPC ..... *B26B 5/001* (2013.01)

(58) Field of Classification Search
CPC ..... B26B 5/001; B26B 5/00; B26B 1/08
(Continued)

(56) References Cited

U.S. PATENT DOCUMENTS 3,025,598 A * 3/1962 Nissen ..... B26B 5/001 30/162
3,577,637 A * 5/1971 Braginetz ..... B26B 5/001 30/162

(Continued)

FOREIGN PATENT DOCUMENTS

CH 547686 4/1974
DE 7630209 1/1977

(Continued)

OTHER PUBLICATIONS

EP search report dated Feb. 5, 2016 for EP Application No. 15181008.

*Primary Examiner* — Ghassem Alie
*Assistant Examiner* — Bharat C Patel
(74) *Attorney, Agent, or Firm* — Gabriel A. Haboubi

(57) ABSTRACT

A tool includes a housing and a slidable blade assembly configured to move between a first, second and third positions. The blade assembly is configured to receive a removable blade, such that the blade is stored within the housing when the blade assembly is in the first position, a portion of the blade extends outwardly from the housing when the blade assembly is in the second position, and the blade is completely outside of the housing when the blade assembly is in the third position, facilitating removal from the blade assembly. The housing comprises a guide path associated with movement of the blade assembly. The guide path includes a first path portion associated with the blade assembly being in the first position or the second position, and a second path portion associated with the blade assembly being in the third position, the first and second path portions being noncontiguous.

16 Claims, 8 Drawing Sheets

(51) Int. Cl.
*B26B 11/00* (2006.01)
*B25F 3/00* (2006.01)
*B26B 5/00* (2006.01)

(58) Field of Classification Search
USPC ..... 30/123
See application file for complete search history.

(56) References Cited

U.S. PATENT DOCUMENTS 3,708,881 A 1/1973 Bennett
3,879,847 A 4/1975 Roll
3,906,625 A 9/1975 Gringer
4,005,525 A 2/1977 Gringer
4,621,425 A 11/1986 Stoutenberg
4,663,845 A 5/1987 Weimann
4,939,839 A 7/1990 Gorst
5,025,558 A 6/1991 Gilbert
5,054,198 A 10/1991 Gmoch
5,099,578 A * 3/1992 Jan ..... B26B 5/001 30/162
5,644,843 A 7/1997 Young
5,878,501 A 3/1999 Owens et al.
6,161,290 A 12/2000 Takamasa
6,163,963 A 12/2000 Huang
6,314,646 B1 11/2001 Schmidt
6,330,749 B1 12/2001 Khachatoorian et al.
6,357,120 B1 3/2002 Khachatoorian et al.
6,374,497 B1 4/2002 Sun
6,449,850 B1 9/2002 Gilbert
6,460,433 B1 10/2002 Ackeret et al.
6,393,893 B1 12/2002 Ackeret
6,502,311 B1 1/2003 Khachatoorian et al.
6,546,632 B2 4/2003 Gilbert
6,557,262 B1 5/2003 Clemence et al.
6,708,360 B2 3/2004 Ackeret
6,718,639 B1 * 4/2004 Kazanjian ..... B26B 5/001 30/138
6,779,425 B2 8/2004 Ackeret et al.
6,886,257 B2 5/2005 Chih
6,948,409 B2 9/2005 Ackeret et al.
6,966,113 B2 11/2005 Fossella
6,968,622 B2 11/2005 Ping
7,007,392 B2 3/2006 Ping
7,040,022 B2 5/2006 Ping
7,107,688 B1 9/2006 Critelli et al.
7,134,207 B2 11/2006 Ping
7,155,829 B1 * 1/2007 Sun ..... B26B 5/003 30/125
7,178,244 B2 2/2007 Fossella
7,305,770 B2 12/2007 Critelli et al.
7,987,602 B2 8/2011 Kanemoto et al.
8,069,571 B2 12/2011 Chung et al.
8,201,336 B2 6/2012 De
8,484,854 B2 7/2013 Ho
8,695,221 B2 4/2014 Hao
8,793,882 B2 8/2014 Kanemoto et al.
8,819,942 B2 9/2014 Chung et al.
2002/0144407 A1 10/2002 Gilbert
2005/0015996 A1 1/2005 Chih
2011/0197454 A1 8/2011 Zeng
2011/0308090 A1 12/2011 Ho
2012/0174412 A1 7/2012 Ho
2013/0255002 A1 10/2013 Keers et al.
2014/0096658 A1 4/2014 Bellamy
2015/0246451 A1 * 9/2015 Robinson ..... B26B 5/001 30/162

FOREIGN PATENT DOCUMENTS

DE 20303215 5/2003
DE 202008004001 8/2008
DE 202013101416 6/2013
WO WO2009052060 4/2009
WO WO2009086615 7/2009

* cited by examiner

SLIDING BLADE UTILITY KNIFE

This application claims the benefit of U.S. Provisional Application No. 62/037,990, filed Aug. 15, 2014, the disclosure of which is incorporated herein by reference in its entirety.

FIELD OF THE INVENTION

The present invention relates generally to hand tools.

BACKGROUND OF THE INVENTION

Utility knives are often configured to house a replaceable blade, which can selectively retract into or extend out of the handle of the utility knife. Conventionally, utility knife blades are trapezoidal, and are configured so that one side of the blade may be used, while the other side of the blade is held within the housing, fixing the blade relative to the housing. When it is desirable to replace the blade, the blade may be rotated in the blade carriage, so that the side of the trapezoid previously used (and presumably dulled through use) is held within the housing, while the side of the trapezoid previously retained within the housing may be selectively exposed for use. Alternatively, the utility knife blade may be removed entirely (e.g., when both sides of the trapezoidal blade have been thoroughly used) so that the used trapezoidal blade may be replaced by a new blade.

Among other things, the present application relates to an improved blade carriage and sliding mechanism for extending or retracting the utility knife blade, so that the utility knife blade may be easily rotated for utilization of the other side of the blade, or the utility knife blade may be replaced in its entirety.

SUMMARY OF THE INVENTION

According to one aspect of this disclosure, a tool includes a housing and a slidable blade assembly configured to slidably move between a first position, a second position, and a third position. The slidable blade assembly is configured to receive a removable blade such that the blade is stored within the housing when the slidable blade assembly is in the first position, a portion of the blade extends outwardly from the housing when the slidable blade assembly is in the second position, and the blade is completely outside of the housing when the slidable blade assembly is in the third position, facilitating removal of the blade from the slidable blade assembly. The housing comprises a guide path associated with movement of the slidable blade assembly, the guide path including a first path portion associated with the slidable blade assembly being in the first position and the second position, and a second path portion associated with the slidable blade assembly being in the third position. The first path portion is noncontiguous with the second path portion.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only, and are not intended as a definition of the limits of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

BRIEF DESCRIPTION OF THE DRAWINGS

Features of utility knives in accordance with one or more embodiments are shown in the drawings, in which like reference numerals designate like elements. The drawings form part of this original disclosure in which.

DETAILED DESCRIPTION OF THE ILLUSTRATED EMBODIMENT(S)

Figure 1:
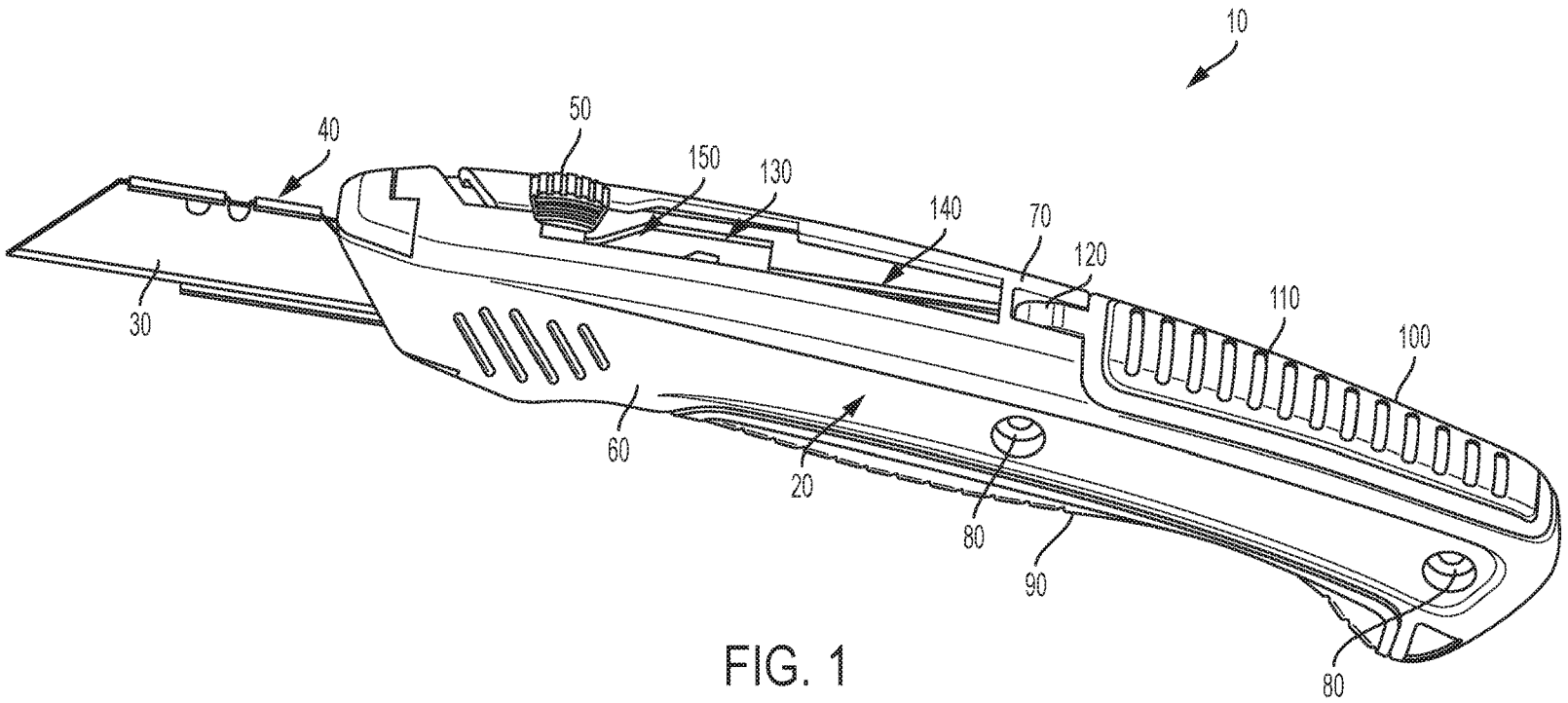
FIG. 1 illustrates a perspective view of a utility knife according to an aspect of the present disclosure.

FIG. 1 illustrates a perspective view of a utility knife 10 of the present disclosure. The utility knife 10 includes a housing 20, configured to receive a utility blade 30 therein. It may be appreciated that a blade carriage 40 or other slidable blade assembly may carry the utility blade 30, and a button 50 coupled to the blade carriage 40 may allow the blade carriage 40 to be selectively retracted into or extended from the housing 20, as discussed in greater detail below.

In an embodiment, the housing 20 may include a first side 60 and a second side 70, which may be separately formed, but assembled and secured together. In the illustrated embodiment, screws inserted in associated screw holes 80 may fix the first side 60 to the second side 70. As further shown, in an embodiment a grip 90 may also be provided on the housing 20. In an embodiment, the grip 90 may be formed of a resilient material, configured to provide a comfortable or molded grip for a user of the utility knife 10. In an embodiment, the grip 90 may extend across the first side 60 to the second side 70, so as to further couple the first side 60 to the second side 70.

In an embodiment, the housing 20 may include blade storage 100. For example, in an embodiment the first side 60 and the second side 70 may together form a storage space selectively covered by a lid 110. As illustrated in FIG. 1, in an embodiment the first side 60 and second side 70 may be configured to receive a pivot region 120 of the lid 110, so that the lid 110 may pivot relative to the remainder of the housing 120. It may be appreciated that spare blades may be stored in the housing 20, and may be accessed by lifting the lid 110.

As described in greater detail below, in an embodiment a guide path 130 for the blade carriage 40 may be formed in the housing 20 (e.g., by the assembly of the first side 60 and the second side 70). As shown, the guide path 130 may include a rear path portion 140 and a forward path portion 150. It may be appreciated that movement of the blade carriage while the button 50 is in the rear path portion 140 may facilitate sliding the blade between a fully retracted position and one or more partially extended positions, where the blade 30 may be used. As shown, when the button 50 is in the forward path portion 150, the blade carriage 40 may be extended so that the blade 30 is fully outside of the housing 20, facilitating removal and replacement of the blade 30.

Figure 2:
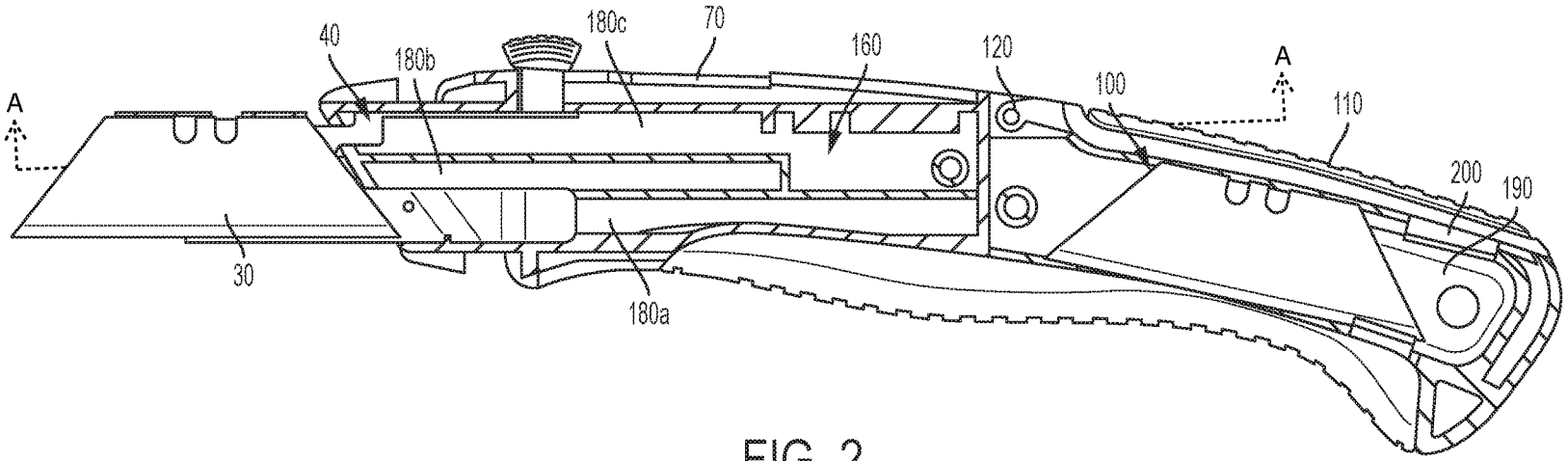
FIG. 2 illustrates a side view of the utility knife of FIG. 1, with one side of the housing removed to show an interior thereof.

FIG. 2 illustrates a side view of the utility knife 10, with the first side 60 removed so as to show the interior 160 of the housing 20. As shown, the second side 70 of the housing includes channels 180 formed therein configured to receive associated portions of the blade carriage 40, as described below. As further shown in FIG. 2, the blade storage 100 may include a blade storage chamber 190 that may be accessed by pulling the lid 110 upwards away from the housing 20, pivoting the lid 110 at the pivot region 120. In an embodiment the lid 110 may include a resilient catch 200 which may snap into receptacles formed in one or more of the first side 60 and second side 70, and may give under sufficient force to allow the lid 110 to be pivoted away from the housing 20. While in the illustrated embodiment the catch 200 is integral with the lid 110, in other embodiments the catch 200 may be coupled to the lid 110, or may be of any other appropriate configuration.

Figure 3:
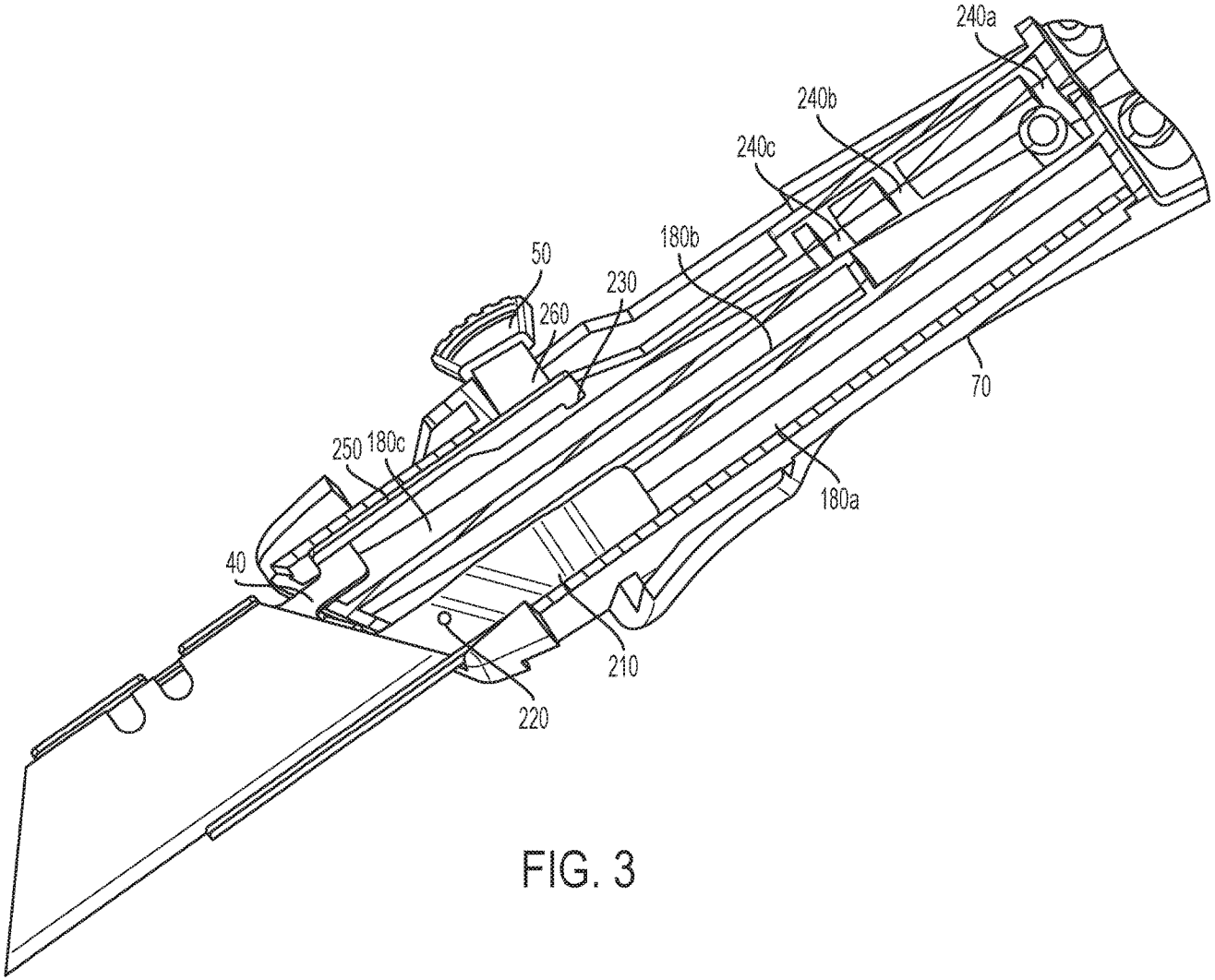
FIG. 3 illustrates a perspective view of the utility knife of FIG. 1, with the side of the housing removed.

FIG. 3 illustrates an enlarged partial perspective view of the utility knife 10 having the first side 60 and the grip 90 removed, to further show a sliding relationship between the blade carriage 40 and the second side 70. For example, as shown, the blade carriage 40 may include a spring clip portion 210, which may generally press against an interior of the first side 60 when the first side 60 is mounted to the second side 70. In an embodiment, a protruding nut 220 may extend into an associated channel 180*a* (e.g., into the view of FIG. 3), to provide desired sliding arrangement between the blade carriage 40 and the housing 20. It may be appreciated that the spring clip portion 210 may generally bias the blade carriage 40 in a desired manner within the housing 20 as the blade carriage 40 is sliding relative to the housing 20, as described in greater detail below.

As further shown in FIG. 3, the blade carriage 40 may include a latch member 230 configured to selectively engage with one or more latch receptacles 240 in the housing 20. In an embodiment, the latch receptacles 240 may be associated with the button 50 being in the rear path portion 140, such that the blade carriage 40 is either fully retracted or is partially extended for use of the blade 30. For example, in the illustrated embodiment, the latch receptacle 240*a* may be associated with the blade carriage 40 (and thus the blade 30) being in the fully retracted position. The latch receptacle 240*b* may be associated with the blade carriage 40 and blade 30 being partially extended for use. The latch receptacle 240*c* may be associated with the blade carriage 40 and blade 30 being fully extended for use of the blade 30 (albeit with the button 50 remaining in the rear path portion 140, and not extending the blade carriage 40 outward from the housing to facilitate replacement of the blade 30, as when the button 50 is extended forward in the forward path portion 150). In an embodiment, the button 50 and latch member 230 may be at the end of an arm 250 extending from the remainder of the blade carriage 40. In an embodiment, the arm 250 may be of sufficient resiliency such that the latch member 230 may be biased into the latch receptacles 240, preventing sliding movement of the blade carriage 40 and the button 50 until the latch member 230 is moved out of the latch receptacle 240. Accordingly, in the illustrated embodiment, to unlatch the latch member 230 from the latch receptacle 240, the user of the utility knife 10 may press the button 50 into the housing 20, thus moving the latch member 230 out of the latch receptacle 240 and into the channel 180*c*, at which point the latch member 230 and the remainder of the blade carriage 40 may slide relative to the housing 20. It may be appreciated that resiliency in the arm 250 may bias the latch member 230 to enter another of the latch receptacles 240 during sliding movement of the button 50 and blade carriage 40.

Figure 4:
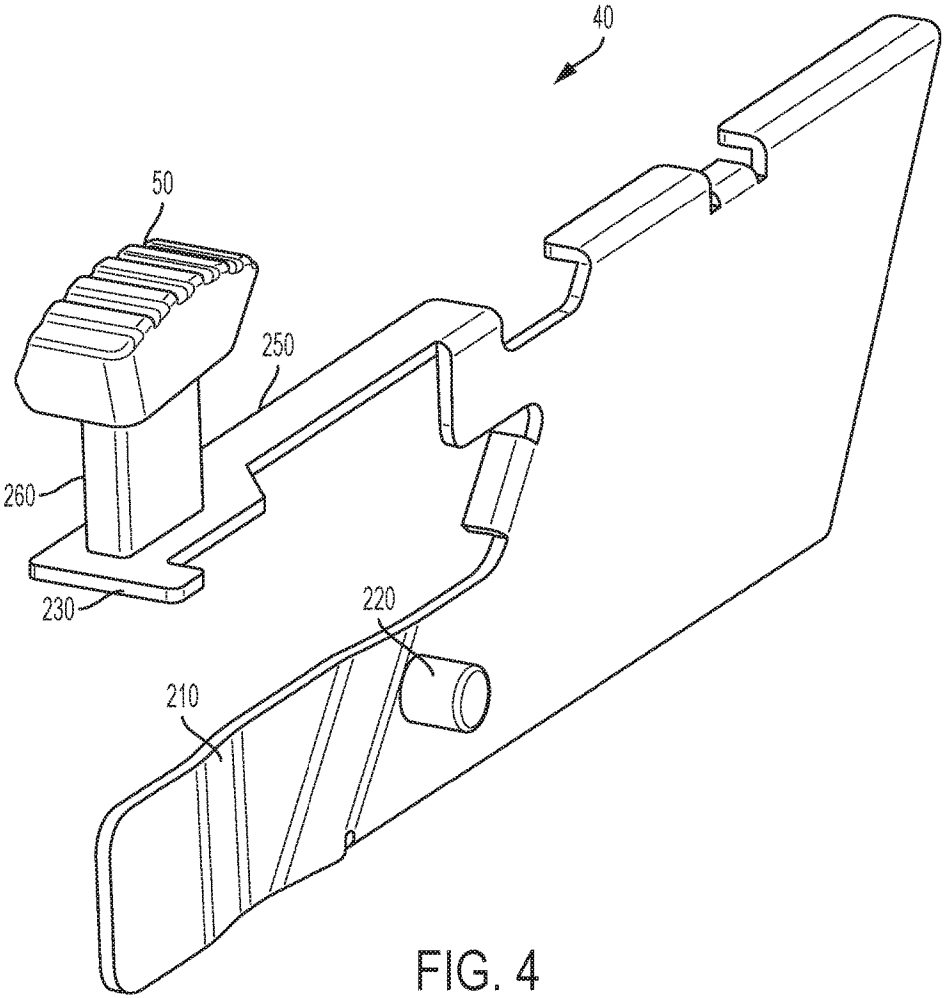
FIG. 4 illustrates an isolated perspective view of the blade carriage of the utility knife of FIG. 1.

FIG. 4 illustrates an isolated perspective view of an embodiment of the blade carriage 40, showing the protruding nut 220, the arm 250, latch 230, and button 50. As shown, in an embodiment the button 50 is coupled to the arm 250 by a post 260, described in greater detail below.

Figure 5:
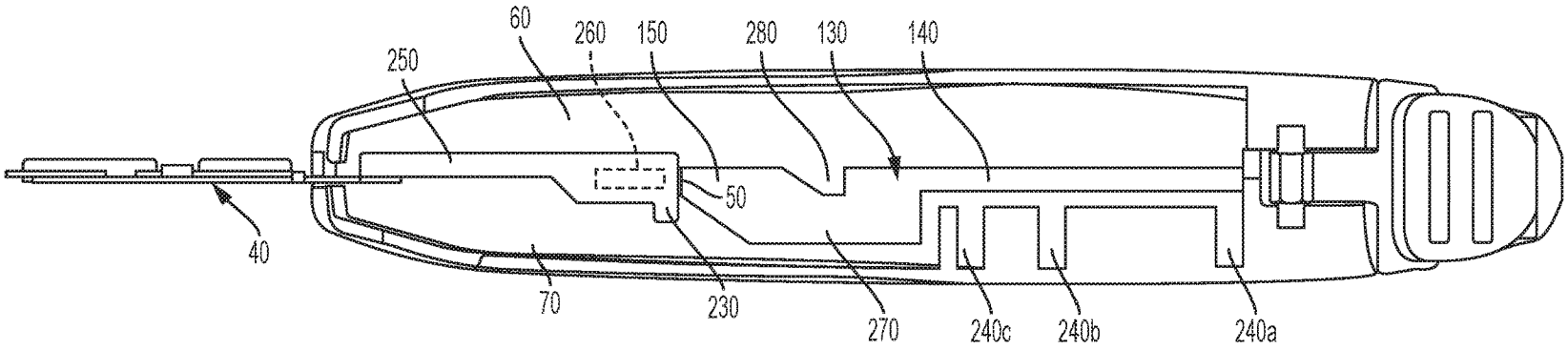
FIG. 5 illustrates a partial cross sectional view of the utility knife of FIG. 1, as viewed upward as indicated by section A-A indicated in FIG. 2, showing a sliding path for the blade carriage thereof.

As shown in FIG. 5, it may be appreciated that the guide path 130 including the rear path portion 140 and the forward path portion 150 may be formed in a space between portions of the first side 60 and second side 70. In an embodiment, the space may be generally sized to receive the post 260 extending between the arm 250 and the button 50. Accordingly, the size of the space relative to the post 260 may prevent the arm 250 from being pulled out through the space (e.g., by structure such as the latch member 230), and similarly the size of the space may prevent the button 50 from being pushed an undesirable depth into the housing 20. Specifically, FIG. 5 illustrates a cross sectional view from the bottom of the utility knife 10, along the channel 180*c*, showing the arm 250 and latch member 230, as well as the space defining the rear path portion 140 and the forward path portion 150. The latch receptacles 240 are also visible, showing how the latch member 230 would be received in the latch receptacles 240 as the blade carriage 40 is received deeper within the housing 20 (i.e., when the post 260 is extending through the rear path portion 140).

As shown in the illustrated embodiment, the rear path portion 140 may be noncontiguous with the forward path portion 150, so that movement of the post 260 along the guide path 130 requires moving the post 260 in a different direction than in the direction of the rear path portion 140. As shown, an intermediate path portion 270 couples the rear path portion 140 to the forward path portion 150 in the guide path 130. It may be appreciated that the intermediate path portion 270 may extend adjacent to but at least partially in a different direction from the direction of the rear path portion 140. In an embodiment, movement of the post 260 between the rear path portion 140 and the intermediate path portion 270 is at least partially in a direction that is not parallel with the rear path portion. For example, in the illustrated embodiment, movement of the post 260 from the rear path portion 140 to the intermediate path portion 270 includes moving the post 260 generally perpendicular to the direction of the rear path portion 140. In other embodiments, the post 260 may be moved back at an angle in the intermediate path portion 270, before being moved forward again into the forward path portion 150.

In some embodiments, the rear path portion 140 and forward path portion 150 may be parallel to one another. In the illustrated embodiment, the rear path portion 140 and the forward path portion 150 are collinear to each other, while the intermediate path portion 270 extends generally parallel to both the rear path portion 140 and the forward path portion 150. Accordingly, in the illustrated embodiment a flange 280 blocks the post 260 from sliding directly from the rear path portion 140 to the forward path portion 150. As shown in the illustrated embodiment, the flange 280 may be formed on the first side 60. As such, depressing the button 50, and sliding the button 50 and post 260 along the rear path portion 140 may allow the blade carriage 40 to extend from the fully retracted position (when the latch portion 230 is in the latch receptacle 240*a*) to the fully extended for use position (when the latch portion 230 is in the latch receptacle 240*c*), until the post 260 abuts the flange 280. The post 260 can subsequently be moved laterally from the rear path portion 140 into the intermediate path portion 270.

As shown, in an embodiment a slanted wall formed in the second side 70 at the intermediate path portion 270 may allow sliding movement of the post 260 seamlessly from the intermediate path portion 270 into the forward path portion 150, so that the blade carriage 40 can be fully extended for replacement of the blade 30. Similarly, a slanted wall formed on one side of the flange 280 facing the forward path portion 150 may facilitate seamless movement of the post from the forward path portion 150 into the intermediate path portion 270, so that the blade carriage 40 may be easily received back into the housing. Accordingly, in an embodiment movement of the post 260 between the intermediate path portion 270 and the forward path portion 150 may include movement in a direction that forms an acute angle with the first path portion.

It may be appreciated that in other embodiments the guide path 130 may include other angles formed therein between the rear path portion 140 and the forward path portion 150 so as to prevent unintentional movement of the post 260 from the rear path portion 140 (e.g., during use of the knife blade 30).

It may be appreciated that the spring clip portion 210 may be configured to bias the post 260 into the rear path portion 140 and/or the forward path portion 150 when the post 260 is moved into the intermediate path portion 270. Accordingly, the space between the first side 60 and second side 70 may be configured to accommodate lateral movement of the post 250 and spring clip portion 210 during the transition between the rear path portion 140 and the forward path portion 150 via the intermediate path portion 270 (e.g., laterally in a direction at least partially extending away from the general direction of the guide path 130 that facilitates extension and retraction of the blade carriage 40.

Figure 6:
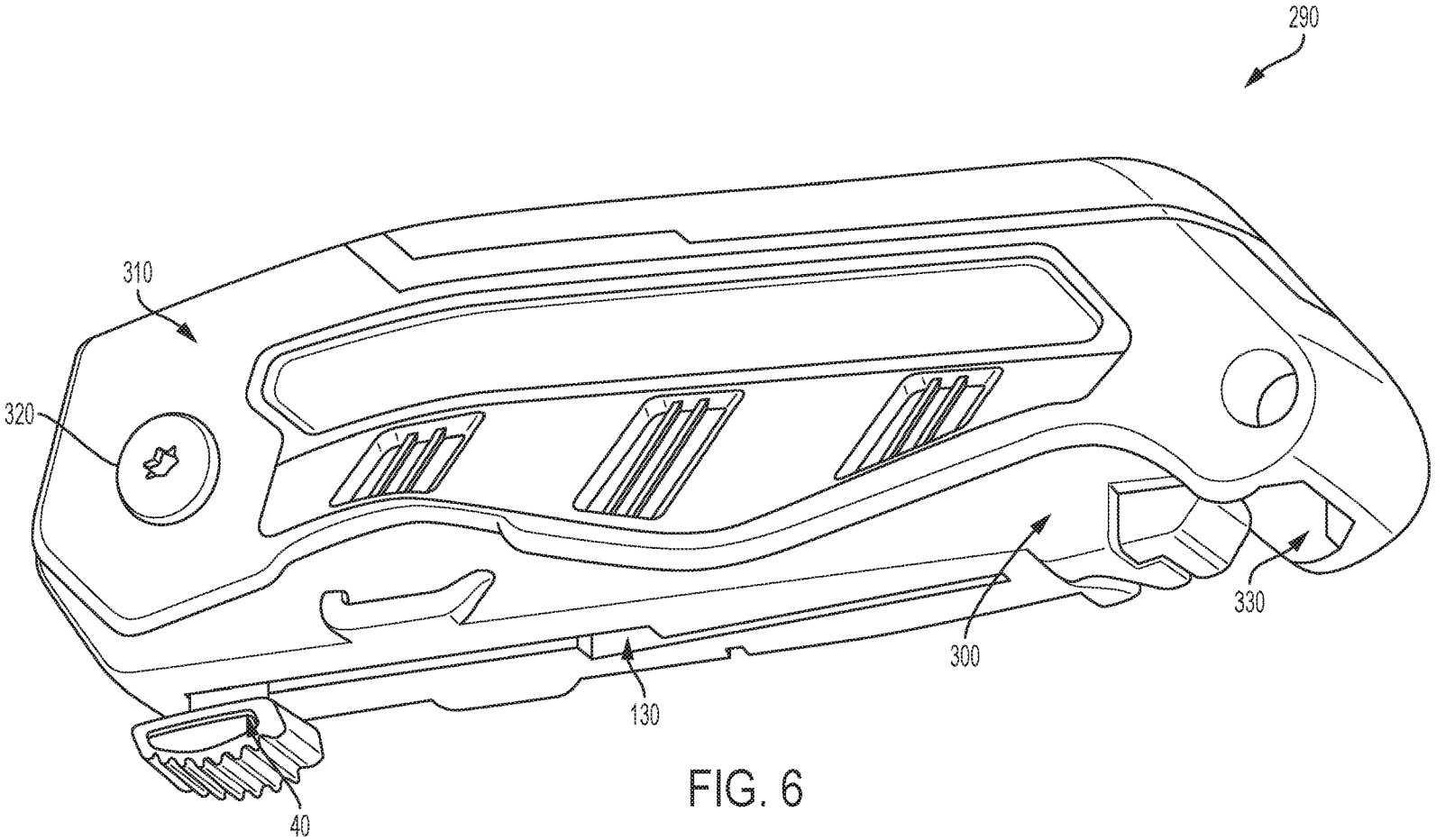
FIG. 6 illustrates a perspective view of an embodiment of a foldable utility knife according to another aspect of the present disclosure, the foldable utility knife being illustrated in a folded configuration.
Figure 7:
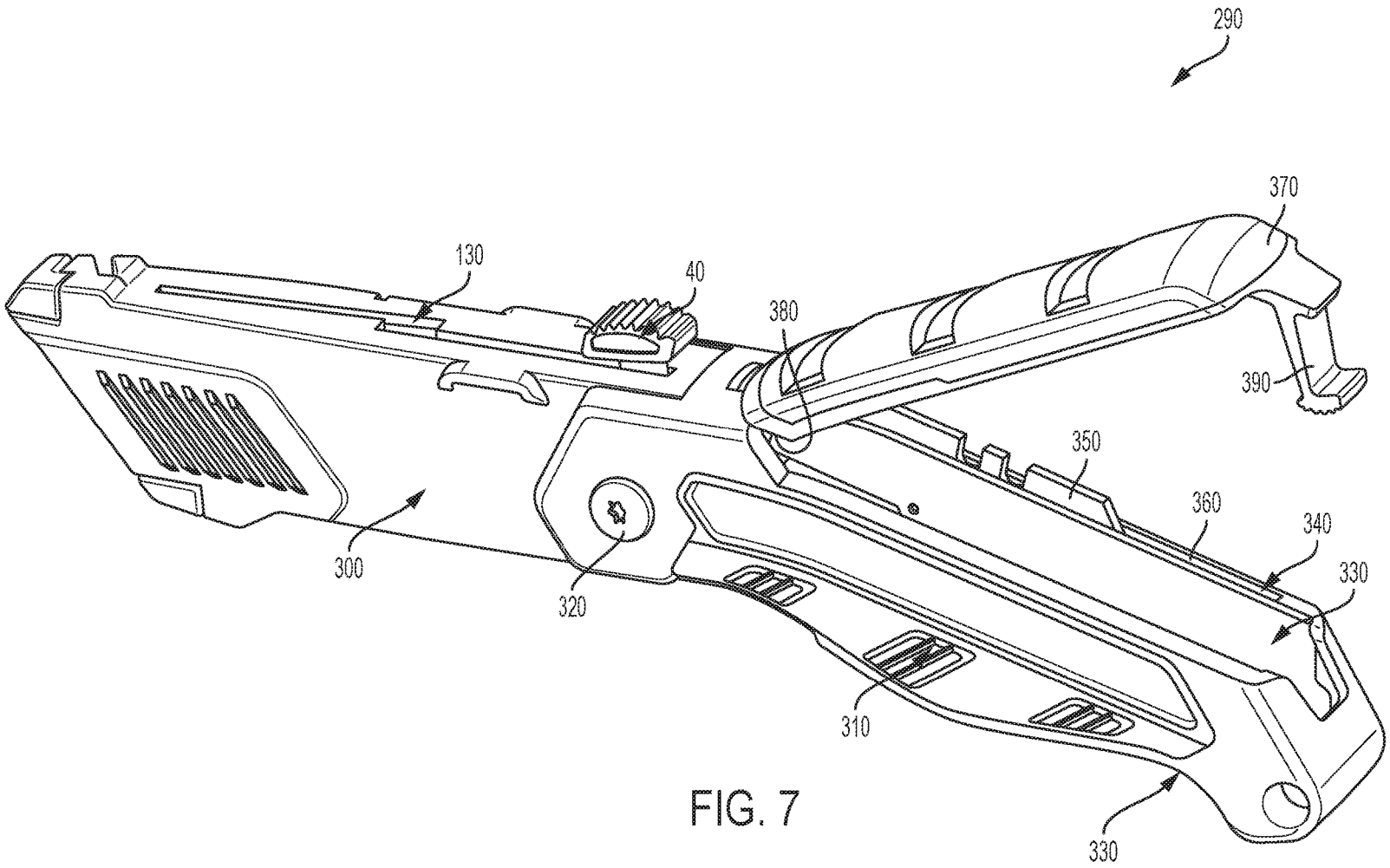
FIG. 7 illustrates a perspective view of the foldable utility knife of FIG. 6, in an unfolded configuration.

It may be appreciated that in some embodiments, features of the present disclosure may be implemented in alternate utility knife housing embodiments. For example, FIG. 6 illustrates a perspective view of an embodiment of a foldable utility knife 290. In the foldable utility knife 290, a first portion 300 that includes the guide path 130 and the blade carriage 40 may be foldable relative to a second portion 310 that may serve as a handle when the first portion 300 is folded to extend from the second portion 310 (as illustrated in FIG. 7, depicting the foldable utility knife 290 in an unfolded configuration). It may be appreciated that the first portion 300 and the second portion 310 may pivot relative to one another at a pivot 320, which in some embodiments may be formed from a bolt, rivet, screw, or other fastener. In an embodiment, the second portion 310 forms an aperture 330 into which the first portion 300 may be pivoted into for storage of the first portion 300 therein, leading to compaction of the foldable utility knife 290.

As shown in FIG. 7, in some embodiments the second portion 310 may include blade storage 340 therein for extra utility knife blades 350. As shown, in an embodiment the blade storage 340 may include a blade storage chamber 360 that may be accessed by pulling a lid 370 upwards away from the second portion 310, pivoting the lid 370 at the pivot region 380. In an embodiment the lid 370 may include a resilient catch 390 which may snap into receptacles formed in the second portion 310, and may give under sufficient force to allow the lid 370 to be pivoted away from the housing second portion 310. While in the illustrated embodiment the catch 390 is integral with the lid 370, in other embodiments the catch 390 may be coupled to the lid 370, or may be of any other appropriate configuration. As further shown in FIG. 7, in an embodiment the blade storage chamber 360 may be formed as a slot in a sidewall of the second portion 310, where an opening to which is exposed when the lid 370 is pivoted away from the second portion 310. In an embodiment, the blade storage chamber 360 may be alongside the aperture 330 into which the first portion 300 pivots when storing the first portion 300 in the second portion 310. In some embodiments, multiple blade storage chambers 360 may be located in the second portion 310 (e.g., on opposing sidewalls of the second portion 310, surrounding the aperture 330 therebetween). Other configurations of blade storage may also be used in embodiments of the utility knife 10 and the folding utility knife 290.

Figure 8:
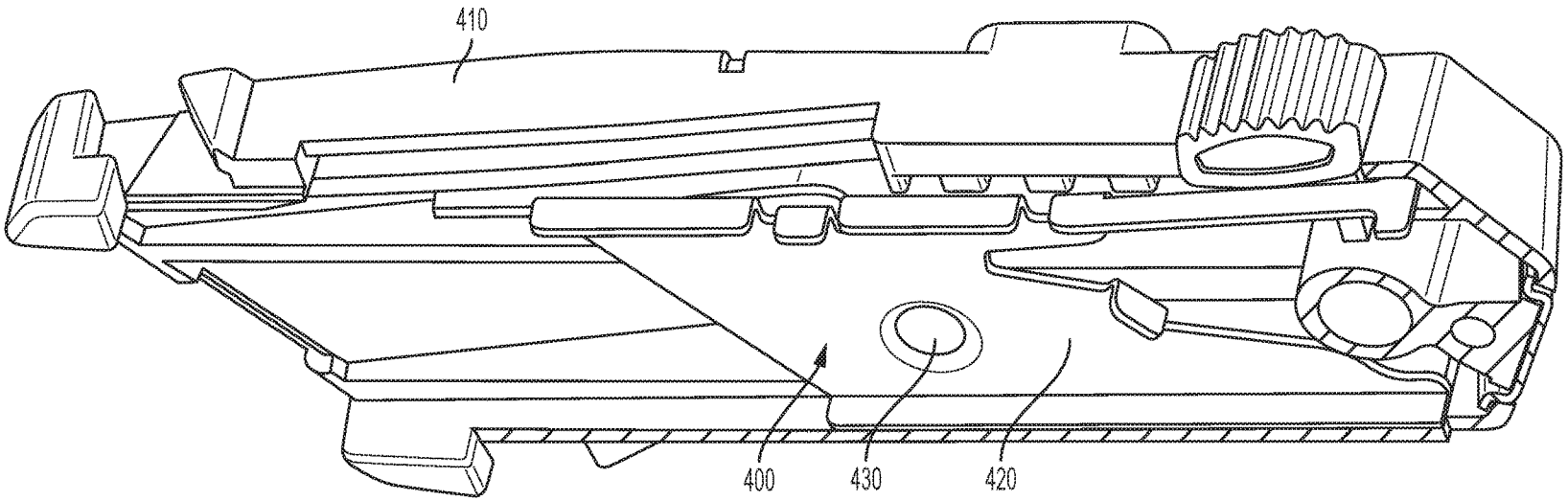
FIG. 8 illustrates an isolated view of an embodiment of a blade carriage having a magnetic blade retention mechanism therein.

In some embodiments of the utility knife 10 or the folding utility knife 290, the blade carriage may include a magnet thereon to hold the blade onto the carriage while the carriage is fully extended, so that the portion of the blade carriage that receives the blade is fully outside of the housing, facilitating removal and replacement of a blade therefrom. For example, FIG. 8 illustrates an isolated view of an embodiment of a blade carriage 400 as mounted on an associated portion 410 of the housing of the utility knife. In the illustrated embodiment, the portion 410 is half of the first portion 300 depicted in FIG. 7, with the other half omitted. As shown, in an embodiment the blade carriage 400 includes a blade receiving portion 420 which may be fully extended forward of the housing (e.g. the portion 410 and the omitted portion of the first portion 300 when assembled together). The blade receiving portion 420 may have a magnetic blade retention mechanism 430 therein, which may hold the blade to the blade receiving portion 420 through magnetic attraction between the magnetic blade retention mechanism 430 and the metal of the blade. It may be appreciated that the magnetic blade retention mechanism may be formed of any appropriate material, including but not limited to rare earth magnets or any other appropriate magnet known in the art.

It may be appreciated that the components described herein may be of different constructions or configurations, including but not limited to one or more being comprised of different material choices. For example, the components described herein may each be constructed from a variety of materials, including but not limited to one or more plastics, metals, rubbers, elastomers, or any other appropriate material choice. For example, in an embodiment one or more of the components may be formed of aluminum (e.g., machined aluminum), iron (e.g., steel), or any other appropriate material. In some embodiments, the material choices may differ from component to component.

Although aspects of the invention have been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A tool comprising:

a housing comprising a first side and a second side;

a slidable blade assembly configured to slidably move between a first position, a second position, and a third position, the slidable blade assembly configured to selectively receive a removable blade such that the blade is stored within the housing when the slidable blade assembly is in the first position, a portion of the blade extends outwardly from the housing when the slidable blade assembly is in the second position, and the blade is completely outside of the housing and exposed for removal of the blade from the slidable blade assembly without removing or separating any portion of the first side or the second side of the housing, when the slidable blade assembly is in the third position; and wherein the housing comprises a guide path formed between the first side and the second side and associated with movement of the slidable blade assembly, the guide path including a first path portion associated with the slidable blade assembly being in the first position and the second position, a second path portion associated with the slidable blade assembly being in the third position and an intermediate path portion coupling the first path portion with the second path portion, wherein a flange of the housing separates the first path portion from the second path portion and defines the intermediate path portion, wherein movement of the slidable blade assembly between the first path portion and the intermediate path portion is at least partially in a first direction that is not parallel with the first path portion, wherein the first direction is towards one of the first side and the second side of the housing, and wherein a latch associated with the slidable blade assembly selectively engages one of one or more latch receptacles formed in the housing and associated with the first position or the second position, and wherein moving the slidable blade assembly in the first direction disengages the latch from the one of the one or more latch receptacles.

2. The tool of claim 1, wherein the first direction that is not parallel with the first path portion is generally perpendicular to a direction of the first path portion.

3. The tool of claim 1, wherein movement of the slidable blade assembly between the intermediate path portion and the second path portion is at least partially in a second direction that is not parallel with the first path portion.

4. The tool of claim 3, wherein the second direction that is not parallel with the first path portion is forms an acute angle with the direction of the first path portion.

5. The tool of claim 1, wherein the first path portion is collinear with the second path portion.

6. The tool of claim 1, wherein the slidable blade assembly is biased into one or more of the first path portion and the second path portion.

7. The tool of claim 1, wherein the slidable blade assembly comprises a post coupled to a button, the post extending from within the housing to the button through a space in the housing defining the guide path.

8. The tool of claim 7, wherein when the slidable blade assembly is in the first position or the second position, sliding movement of the slidable blade assembly is prevented until the button is pressed.

9. The tool of claim 8, wherein pressing the button disengages the latch from the one of the one or more latch receptacles.

10. The tool of claim 7, wherein the button is biased to an unpressed position when the button is pressed.

11. The tool of claim 7, wherein the first side is coupled to the second side, wherein the space in the housing defining the guide path is formed between the first side and the second side.

12. The tool of claim 1, wherein the housing comprises a first portion pivotable relative to a second portion, such that the first portion may be stored within an aperture in the second portion.

13. The tool of claim 1, further comprising blade storage to contain one or more additional blades within the housing.

14. The tool of claim 13, wherein the blade storage is accessible via a lid pivotable relative to the housing.

15. The tool of claim 14, wherein the housing comprises a first portion pivotable relative to a second portion, such that the first portion may be stored within an aperture in the second portion; and wherein the blade storage is located adjacent to the aperture inside the second portion.

16. The tool of claim 1, wherein the slidable blade assembly comprises a magnet configured to hold the blade against the slidable blade assembly.

* * * * *